US005096209A

United States Patent [19]

Ross

[11] Patent Number: 5,096,209

[45] Date of Patent: Mar. 17, 1992

[54] SEAL ELEMENTS FOR MULTIPLE WELL PACKERS

[75] Inventor: Colby M. Ross, Carrollton, Tex.

[73] Assignee: Otis Engineering Corporation, Dallas, Tex.

[21] Appl. No.: 587,074

[22] Filed: Sep. 24, 1990

[51] Int. Cl.[5] ..... F16J 9/00; E21B 23/00

[52] U.S. Cl. ..... 277/207 A; 277/193; 277/199; 166/179; 166/196

[58] Field of Search ..... 277/207 A, 193, 195, 277/198, 199, 208, 209; 16/2; 166/196, 191, 192, 179; 285/910, 338, 196, 161, 342, 343, 346, 177; 174/152 G, 153 G, 65 G

[56] References Cited

U.S. PATENT DOCUMENTS

| | | | |
|---|---|---|---|
| 2,565,130 | 8/1951 | Humason | 166/196 |
| 2,615,741 | 10/1952 | Nathan | 277/208 |
| 3,046,028 | 7/1962 | Nathan | 277/208 |
| 3,167,127 | 1/1965 | Sizer | 166/120 |
| 3,185,501 | 5/1965 | Bonman et al. | 285/342 |
| 3,288,218 | 11/1966 | Young | 166/119 |
| 3,381,752 | 5/1968 | Elliston | 166/120 |
| 3,554,569 | 1/1971 | Gorman | 277/209 |
| 3,666,010 | 5/1972 | Harris | 166/196 |
| 3,851,705 | 12/1974 | Jett et al. | 166/120 |
| 4,413,677 | 11/1983 | Perkins | 166/55.1 |
| 4,505,332 | 3/1985 | Mills et al. | 166/120 |
| 4,512,399 | 4/1985 | Gano et al. | 166/120 |
| 4,703,136 | 10/1987 | Hauff | 277/193 |
| 4,852,649 | 8/1989 | Young | 166/189 |

*Primary Examiner*—William A. Cuchlinski, Jr.
*Assistant Examiner*—Daniel G. DePumpo
*Attorney, Agent, or Firm*—Albert W. Carroll

[57] ABSTRACT

Seal elements for use on well packers having multiple mandrels for sealing between the packer and the inner wall of a well pipe. The seal elements (center elements and/or end elements) are provided with voids therein for controlling the stresses created in the elements during setting of the packers while minimizing the strains resulting from such stresses. The voids are preferably cavities and are readily formed in the elements as they are molded.

33 Claims, 11 Drawing Sheets

SEAL ELEMENTS FOR MULTIPLE WELL PACKERS

BACKGROUND OF THE INVENTION

1. Field of the Invention

This invention relates to well tools and more particularly to seal elements for use on dual well packers.

2. Related Art and Information

Multiply completed wells are so constructed as to permit simultaneous and separate production from two or more different pay zones. Early dual wells were provided with a single string of tubing and had a single well packer between the two pay zones. The lower zone produced through the tubing and the upper zone produced through the tubing-casing annulus.

Multiple completions were later improved to make them easier to control, safer, and more economical. For many years it has been common practice to provide a string of tubing for each of the multiple pay zones with a multiple packer above each pay zone except for the lowermost zone which has a single packer above it. Thus, such a well has a single packer between the lower two zones, a dual packer above the next upper zone, a triple packer above the next, and so on. Thus, a dual packer has two mandrels passing through its seal elements, a triple packer has three, and a quadruple packer has four.

In addition to mandrels passing through the seal elements, it is often desirable to also have other elongate cylindrical members extend through the elements. Such cylindrical elements may include control lines, bypass tubes, injection tubes, as for chemicals for instance, electrical lines, electrical feed through connections, or the like.

In many cases, the seal elements of multiple packers have successfully held only moderate pressures without leaking. It has been desirable to provide seals which would hold much higher pressures without leaking.

Applicant is familiar with the following listed prior patents which disclose dual packers, each being hydraulically actuated and each having a central seal element disposed between upper and lower end elements.

| | | | |
|---|---|---|---|
| 3,167,127 | 3,288,218 | 3,381,752 | 3,851,705 |
| 4,413,677 | 4,505,332 | 4,512,399 | 4,852,649 |

U.S. Pat. No. 3,167,127 which issued to Phillip S. Sizer on Jan. 26, 1965; U.S. Pat. No. 3,288,218 which issued to Carter Young on Nov. 29, 1966; U.S. Pat. No. 3,381,752 which issued to Thomas L. Elliston on May 7, 1968; U.S. Pat. No. 3,851,705 which issued to Marion Barney Jett, et al, on Dec. 3, 1974; U.S. Pat. No. 4,413,677 which issued to Donald H. Perkins on Nov. 8, 1983; U.S. Pat. No. 4,505,332 which issued to Aubrey C. Mills, et al, on Mar. 19, 1985; and U.S. Pat. No. 4,512,399 to John C. Gano and Donald H. Perkins on Apr. 23, 1985, each show a hydraulically actuated dual packer on which is mounted a set of packer seals. This seal set consists of three elements: a central dual element between an upper and a lower end element. These seal sets are obviously well known and have been in use for years, and are of a type which has been known to leak at much lower pressure than has seemed reasonable.

U.S. Pat. No. 4,852,649 issued to Carter R. Young on Aug. 1, 1989 and discloses packer elements for multiple well dual packers. These packer elements are molded in one or two pieces. Each of these elements is formed with slots, slits, or slip surfaces for allowing one portion of the polymeric body of the element to move or slip relative to an adjacent portion thereof in order to provide more uniform distribution of stresses within the elements when they are compressed longitudinally to cause them to expand laterally to sealing engagement between the dual mandrels of the packer and the inner wall of the well casing. While such elements brought about more uniform distribution of stresses in the elements, the problem was not solved because the polymeric material of the element body had to move too far in certain areas, and this resulted in frequent failure due to leakage.

The present invention is an improvement in dual packer elements, and in particular an improvement over the dual packer elements disclosed in U.S. Pat. No. 4,852,649 to Carter R. Young. The present invention provides multiple packer elements which function more efficiently to seal against both low and high differential pressures, provide good distribution of stresses in the polymeric material of the elements, and greatly minimizes the maximum distance which any portion of the element is required to travel and the associated elastic strain in its deformation from its relaxed condition to its expanded sealing condition. Further, these improved dual elements lend themselves more readily to the molding processes and can, thus, be manufactured with greater facility and more economically.

SUMMARY OF THE INVENTION

The present invention is directed toward improved seal means for well packers having multiple mandrels. The improved seal means is provided with voids located therein in regions where, during distortion of the seal means from its initial relaxed condition to its sealing condition, the path of least resistance to flow of the polymeric material of which the seal means is made will be in a longitudinal direction, and in other regions where the direction of flow is to be in a lateral direction voids are not provided. Thus, the present invention is particularly directed to seal means for multiple packers which are provided with voids therein which during their distortion to sealing condition will cause their polymeric material to flow longitudinally where desired and laterally where desired so that stresses built up therein will be substantially uniformly distributed therethrough. This is very desirable and will prevent several types of failure. Both center and end elements may be provided with the needed voids, and these preferably in the form of cavities. The center element may be formed in two pieces which makes it easier to provide the needed cavities therein of the desired size and shape, and at the desired locations. Two configurations of the end elements are provided. One of these end elements has a single large central cavity formed in its inward face where it will be next to the center element. The other end element is formed with plural cavities formed in its inward face according to the number of mandrels in the packer. These cavities do not intersect any of the multiple bores. An element stack almost always comprises a center element between a pair of end elements.

None of the prior art with which Applicant is familiar teaches such element stacks, center elements, or end elements having voids formed therein for controlling the distortion of its polymeric material during setting of a packer in order to provide uniform distribution of the stresses therein. Uniform distribution of the stresses in the seal elements provides several desirable advantages among which are: the ability to use a center element of lesser durometer so that the elements will more readily seal against low pressure differentials; prevents excessive build-up of stresses between or among the multiple mandrels which can cause them to bow outwardly and prevent them from telescoping freely through the relatively movable abutment which interferes greatly with distortion of the elements and prevents building up proper stress levels therein since much energy is wasted by the resistance of the bowed and/or jammed mandrel or mandrels; and may prevent damage to packer parts, such as the movable abutment, mandrels, and the seal elements themselves.

It is therefore one object of this invention to provide seals for multiple packers wherein the seals have voids therein which will automatically cause substantially uniform distribution of stresses built up therein during distortion of the elements from their initial relaxed condition to a position of sealing engagement between the packer and the inner wall of a well pipe.

Another object of this invention is to provide both center seal elements and end elements for multiple packers with voids therein for controlling longitudinal flow and the associated elastic strain of the sealing material during distortion thereof to sealing condition where such longitudinal flow is desirable and having no voids therein so that lateral flow of sealing material will be caused to take place where such lateral flow is desirable.

Another object is to provide such seal elements wherein the voids are provided in the form of cavities.

Another object is to provide seal elements of the character described for use at the end of a stack of seal elements which are provided with a concentric cavity formed in the inward face thereof, which inward face will be engaged by the center element in the stack.

It is one object of this invention to provide an improved seal element stack, including center and end elements, for multiple packers which have means formed therein which allow more uniform distribution of stresses within the elements together with minimal movement of the element material during deformation (reduced elastic strain) of the elements from their initial relaxed position to their expanded sealing position.

Another object is to provide such improved center elements and end elements which can be molded with facility and at reasonable cost.

Another object is to provide such improved seal elements for multiple packers which are better adapted to sealing against both low and high pressure differentials.

Other objects and advantages will become apparent from reading the description which follows and from studying the accompanying drawing wherein:

DESCRIPTION OF THE PREFERRED EMBODIMENTS

Figure 1:
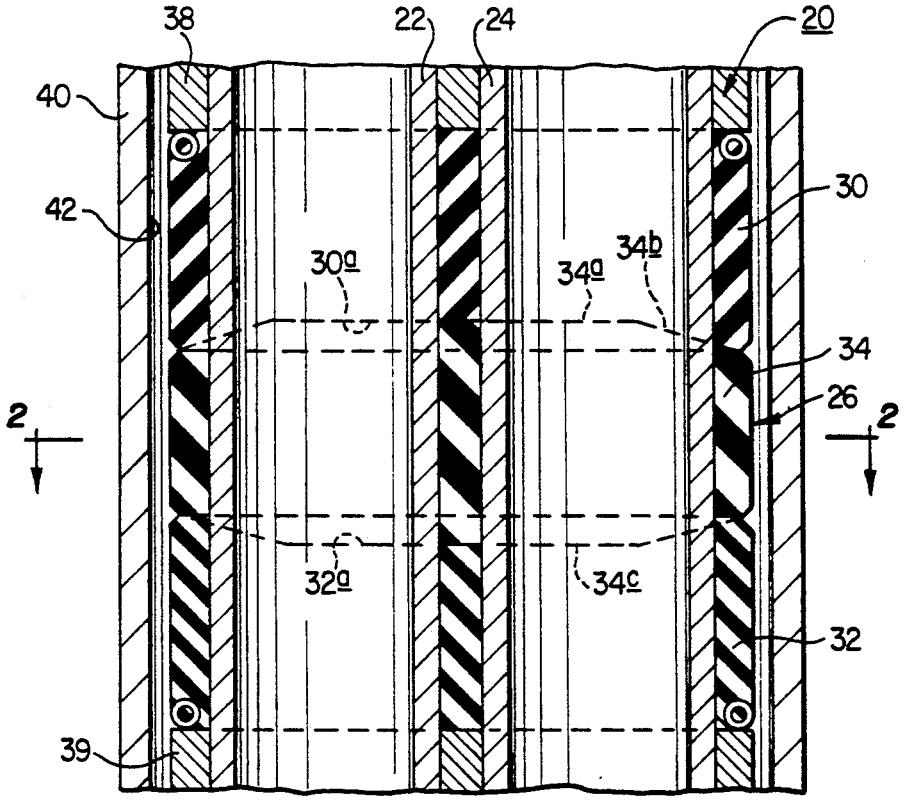
FIG. 1 (PRIOR ART)
FIG. 1 is a fragmentary longitudinal sectional view showing a prior art dual packer having a set or stack of three seal elements thereon as it is being lowered into a well casing.

Referring now to FIG. 1, it will be seen that a prior art packer 20 is provided with a pair of mandrels 22 and 24 about which is disposed a prior art resilient seal element stack 26 comprising an upper seal element 30, lower seal element 32, and a center seal element 34 therebetween. Upper and lower seal elements 30 and 32 may be exactly alike, as shown, but do not have to be so. As shown, the center seal element is thicker at its center as at 34*a* than at its outer edge. This center seal element 34 is also chamfered as at 34*b*. The lower face of the upper end seal element is recessed as at 30*a* to correspond to the raised face 34*a* of center seal element 34. Likewise, lower end element 32 has its upper face recessed as at 32*a* to correspond to the lower face 34*c* of center seal element 34. Thus, there are no voids between these adjacent seal elements.

The seal element stack 26 is adapted to be compressed longitudinally as the upper and lower abutments 38 and 39 are forced toward one another as the packer 20 is actuated to sealing condition in the well casing 40. This longitudinal compression of the seal elements results in lateral expansion thereof. Thus, the elements are forced to distort and to seal between the exterior of the mandrels 22, 24 and the inner wall 42 of casing 40.

Such seal element stacks have been used extensively in the oil and gas industry and have performed satisfactorily in most cases. However, as deeper petroleum reservoirs are tapped, higher pressures are encountered. Higher pressure differentials require higher stresses in the seal members. It is well-known that the stresses developed in resilient seals must at least equal and preferably exceed the pressures which they are to withstand. This is not such a great problem in the case of single packers (not shown) where the polymeric material is evenly distributed about the mandrel. The compression of the seals is also uniform and the resultant stresses in the seals are substantially uniform. This is not so true in the case of packers having multiple mandrels, as is seen in U.S. Pat. No. 4,852,649 which is incorporated into this present application for all purposes.

Figure 2:
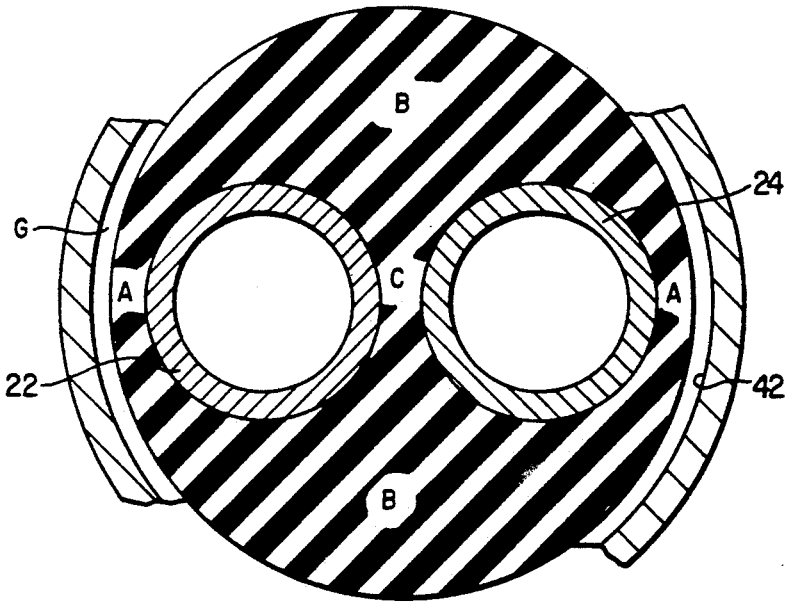
FIG. 2 (PRIOR ART)
FIG. 2 is a fragmentary cross-sectional view taken along line 2—2 of the prior art packer of FIG. 1.

It is noted in FIGS. 1 and 2 that there is a sizeable gap or clearance G between the outside of the seal elements and the inner wall 42 of the casing 40. This gap G must be bridged and sealed by expansion of the seal elements by compressing them longitudinally. Note also that the polymeric material is thin at the regions indicated by A and is much thicker at regions B. Also, the polymeric material between the mandrels at region C completely fills the space between the mandrels and is trapped, and when compressed longitudinally, can expand only in the general direction of regions B.

Ordinarily, a stack of seal elements such as that indicated here at 26 would be compressed longitudinally about 20 percent, that is, to about 80 percent of its initial, uncompressed height when fully set. There is very little polymeric material in the region A, yet the gap in that area is the same as the gap opposite region B. Thus, this material would maybe require as much as 40 percent compression. The region B has a great volume of polymeric material and this volume would need only about 15 percent compression, yet it will be further added to when that material between the two mandrels is compressed because this region may need only 5 percent compression.

Thus, it is understood that the polymeric material is not distributed uniformly about the mandrels. There is an excess of polymeric material in the area C between the mandrels and an excess of such material in the regions B, but a lack of such material in the regions A. Therefore, as the stack of seal elements is compressed longitudinally and expanded laterally, there must be considerable lateral flow of the polymeric material. This great lateral displacement results in high compressive and tensile loads in various regions of this material and may cause the material to fail, that is, to break, or pull away from the packer mandrels or casing. Such failures can cause leakage, flow cutting, holes in casing or tubing, commingling of pay zones, uncontrolled flow, fires, or contamination of land, air and/or water.

Figure 3:
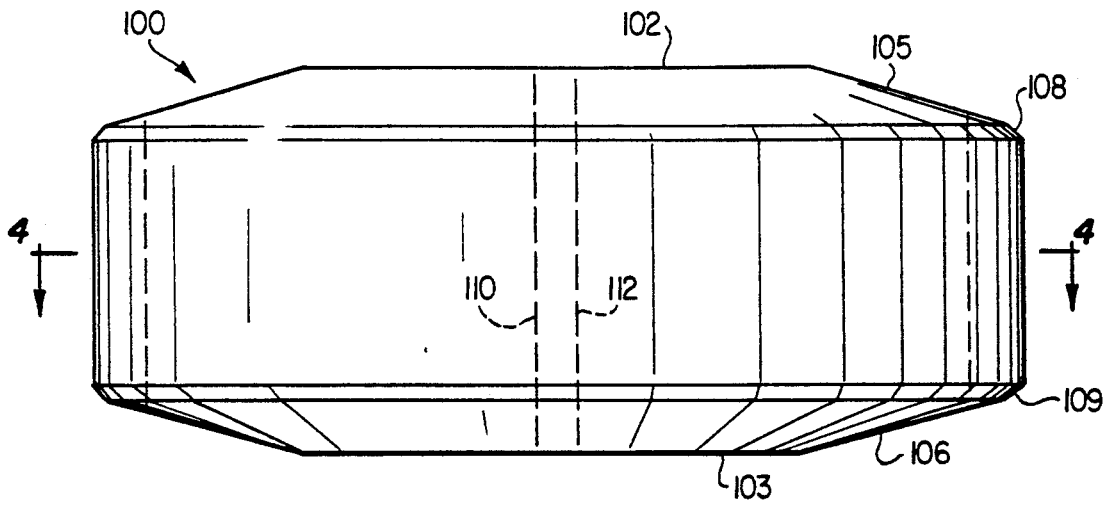
FIG. 3 is a longitudinal view in elevation showing a center dual seal element of this invention.
Figure 4:
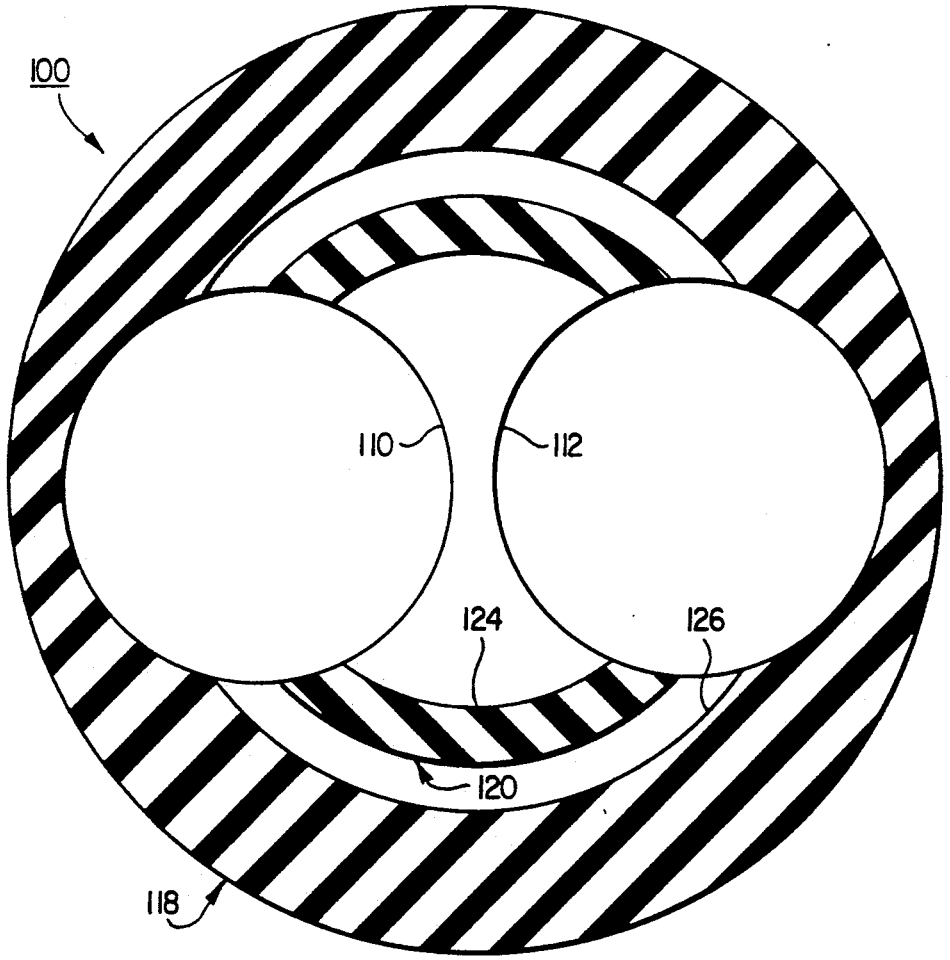
FIG. 4 is a cross-sectional view taken along line 4—4 of FIG. 3.

In FIGS. 3–11 there is illustrated an improved center seal element for dual packers and that element will now be described. Referring to FIGS. 3 and 4 in particular, it is seen that the illustrated seal element is indicated by the reference numeral 100. The element 100 is formed of a suitable polymeric material and has substantially the same shape as does the center element 34 of FIG. 1 previously described.

Element 100 has upper and lower faces 102 and 10 with upper and lower chamfers 105 and 106 and upper and lower bevels 108 and 109. Further, the seal element 100 is provided with a pair of parallel longitudinal bores 110 and 112, as shown. This seal element is made in two pieces as is shown in FIGS. 4–8. As clearly seen in FIGS. 4 and 5, this seal element assembly 100 comprises outer member 118 and core member 120, and when assembled as shown, provides a pair of parallel bores 110 and 112.

A first cavity 124 having a round outer extent or bottom 125 is provided in the core member 120 as shown, and a second cavity 126 is formed in the outer member. These cavities are better seen in FIGS. 5–8.

Figure 5:
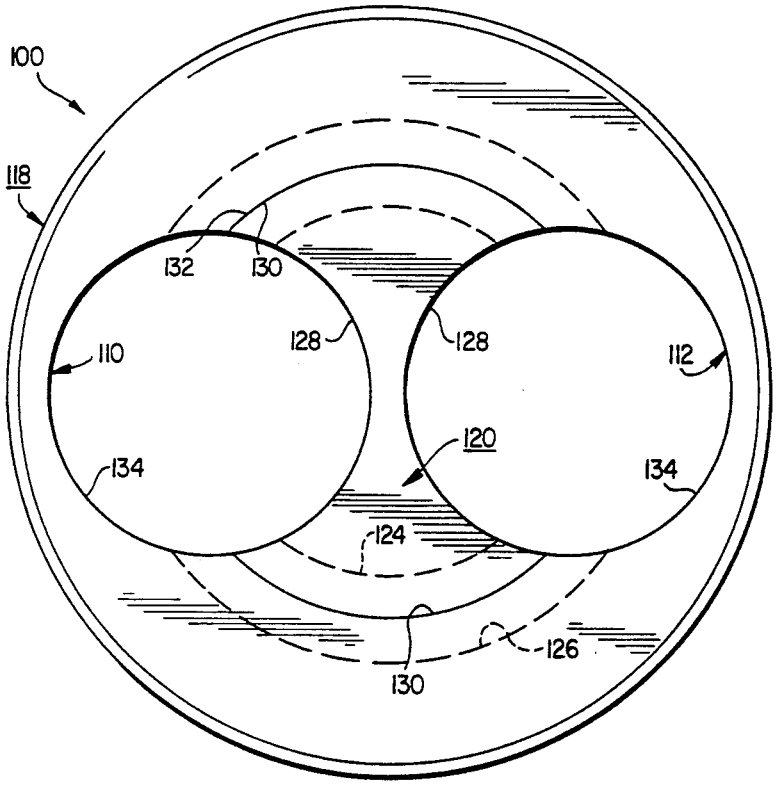
FIG. 5 is a plan view of the center seal element seen in FIGS. 3 and 4.

FIG. 5 is much like FIG. 4 but shows the seal element assembly 100 in plan view. The inner surface 130 of the outer member 118 is a reasonably close fit with the outer surface 132 of the core member as shown. The core member 120 is formed separately from the outer member 118 and then assembled therein as shown so that the arcuate recesses 128 of the core member align with the inner arcuate recesses 134 to provide openings 110 and 112 for the packer mandrels such as packer mandrels 22 and 24. The core member 120 is formed with a cavity 124 and the outer member 118 is formed with cavity 126, as shown.

Figure 6:
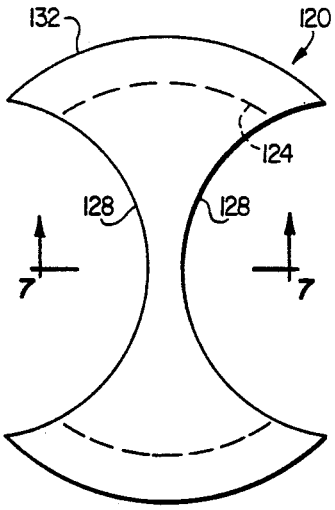
FIG. 6 is a plan view of the core member of the center seal element of FIG. 5.
Figure 7:
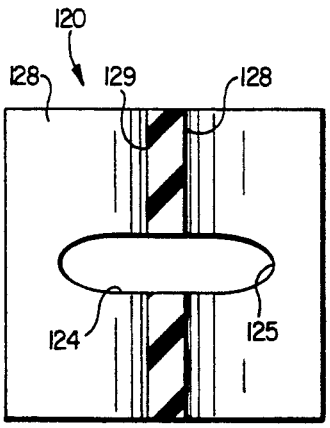
FIG. 7 is a cross-sectional view taken along line 7—7 of FIG. 6.
Figure 8:
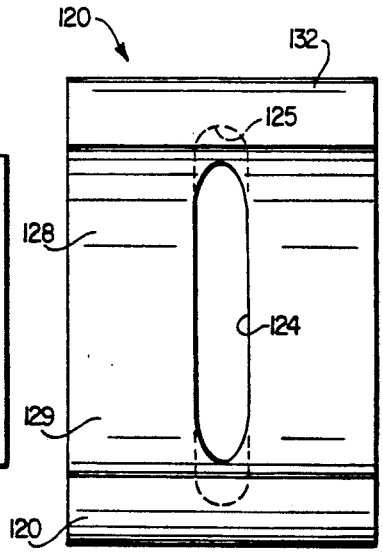
FIG. 8 is a side view of the core member seen in FIG. 6.

In FIG. 6, the core member 120 is shown by itself. It is formed with two outer arcuate walls 120 and with a pair of arcuate recesses 128. It is formed with cavity 124 which opens as shown through the arcuate recesses 128, thus providing a pair of arcuate edges 129. FIG. 7 is a cross-sectional view and shows the extent of cavity 124 as does the side view seen in FIG. 8.

It is readily seen that the cavity 124 of the core member 120 will accommodate a considerable volume of polymeric material at the center of the element and between the two bores for the mandrels. Therefore, the excess material from the region C, FIG. 2, may readily move into cavity 134 and will not have far to flow.

The cavity 126 is formed in the outer member 118 in two arcuate portions, as shown, and can accommodate excess polymeric material from the region B, FIG. 2, without the necessity of such material flowing a great distance.

Figure 9:
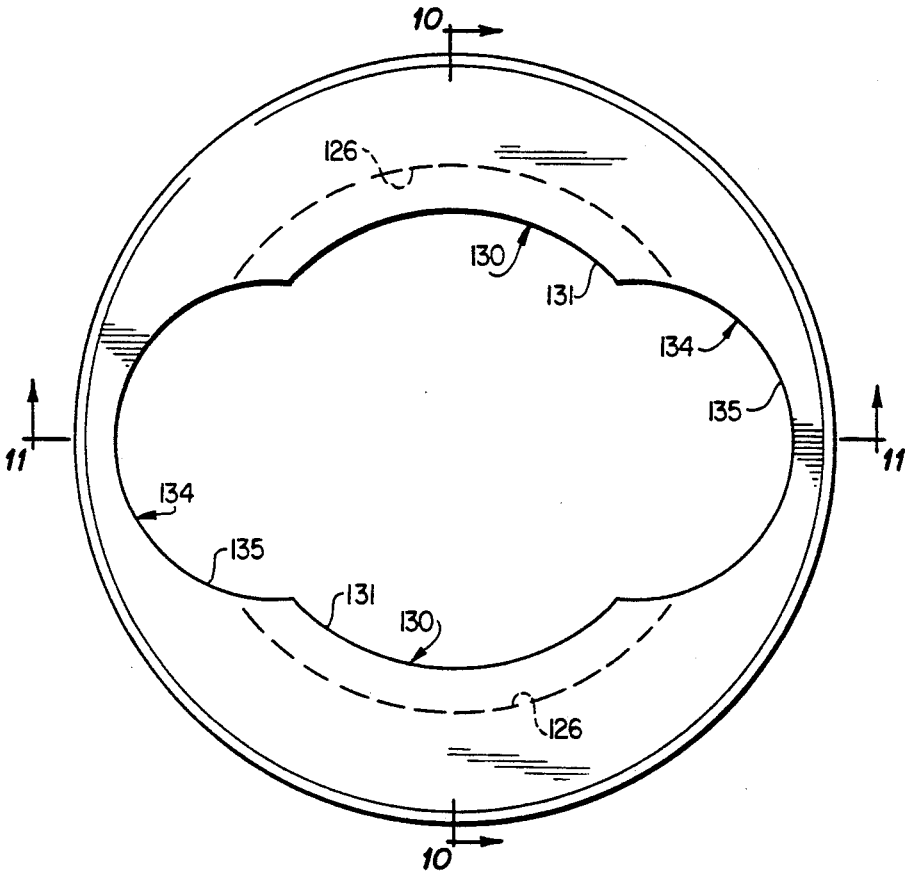
FIG. 9 is a plan view of the outer member of the center seal element seen in FIGS. 3–5.
Figure 10:
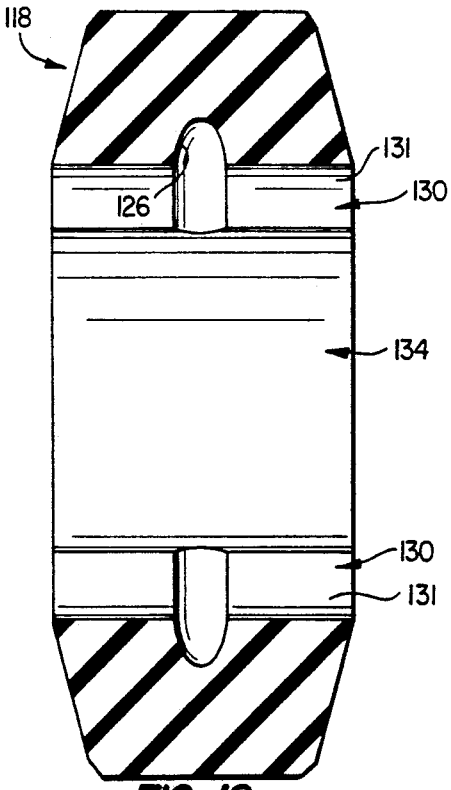
FIG. 10 is a cross-sectional view taken along line 10—10 of FIG. 9.
Figure 11:
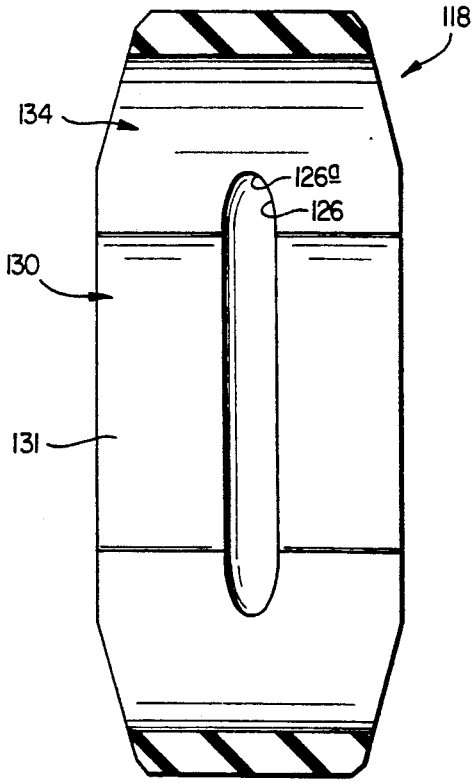
FIG. 11 is a cross-sectional view taken along line 11—11 of FIG. 9.

The outer member 118 of center seal element 100 is better seen in FIGS. 9–11 where it is shown without the core member 120. In these figures, the outer member is shown to be circular and formed with a pair of opposed arcuate inner recesses 134 providing a pair of arcuate walls 135 which will be engaged by the pair of packer mandrels and with a pair of larger opposed arcuate inner surfaces as at 130 which provide a pair of arcuate walls 131 will be engaged by the core member 120, as seen in FIG. 5, for instance. In FIGS. 9 and 11, it is seen that the recess 126 has its opposite ends opening into the arcuate recesses 134.

In FIG. 10, the outer member 118 is shown in section and cavity 126 is clearly visible, as are the arcuate surface 130 and the arcuate recess 134.

In FIG. 11, the cavity 126 of outer member 118 is clearly seen. This cavity is preferably a groove having a round bottom as at 126*a*. It could, however, be formed with a non-round bottom.

It is readily understood that both the core and outer members of the element 100 being designed with curves, circular arcs, round bottom recesses, and the like shapes, will lend themselves well to the molding process and, therefore may be manufactured both readily and economically. In addition, by coring the center element, access to mold the inner cavities becomes economically feasible.

The center seal element 100 described hereinabove is usable with or without end elements which also are formed with cavity means for permitting distortion of the stack of seal elements with no portion of the polymeric mass thereof being required to travel more than a minimal distance.

Figure 12:
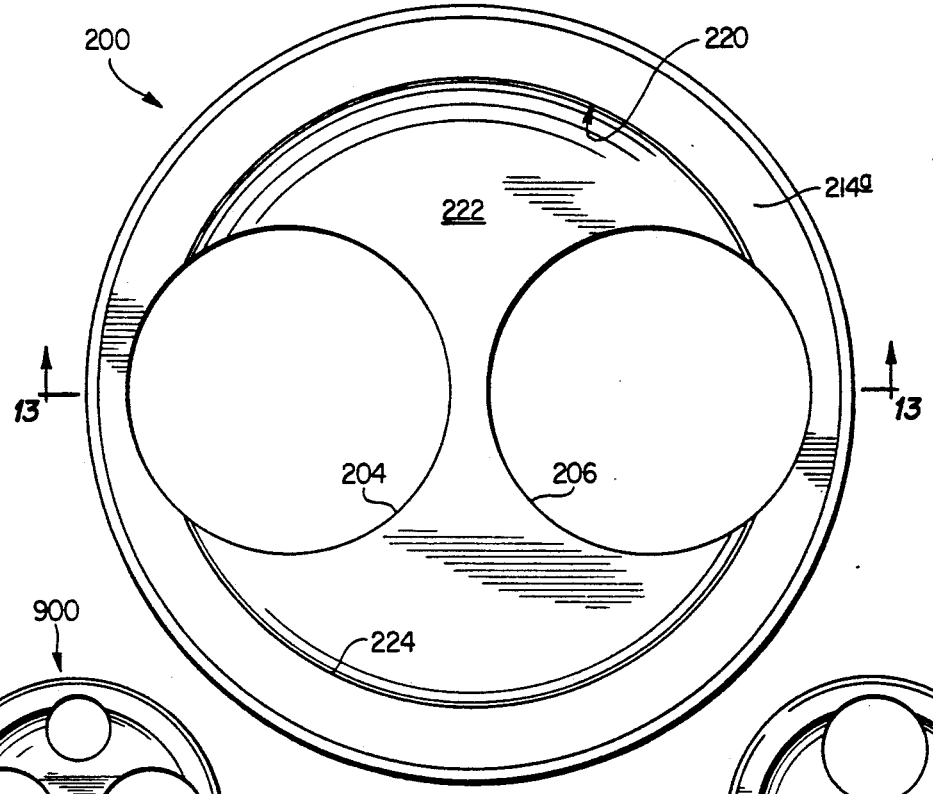
FIG. 12 is a plan view of one form of end seal element of this invention.
Figure 13:
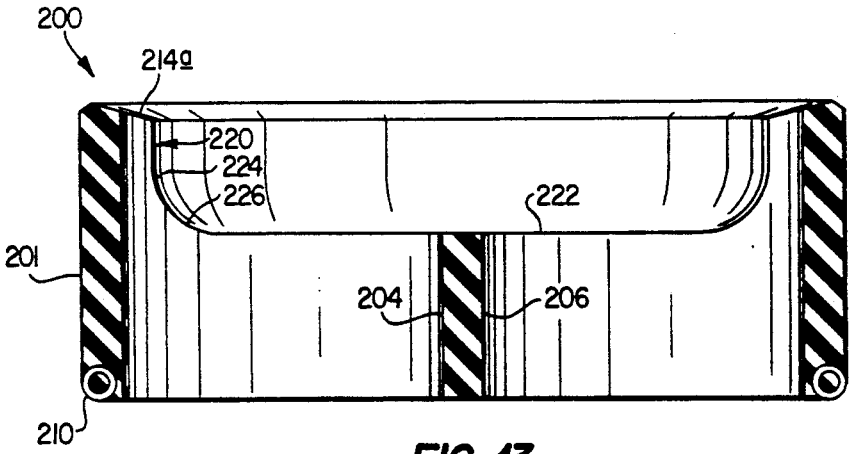
FIG. 13 is a cross-sectional view taken along line 13—13 of FIG. 12.

In FIGS. 12–13 an improved end seal element is illustrated and is indicated generally by the reference numeral 200. This end seal element is formed of a body 201 of suitable polymeric material and is of circular section with a pair of openings 204, 206 therethrough for receiving a pair of packer mandrels as in the case of center element 100, previously described. In the cross-sectional view of FIG. 13, the end element 200 is shown in an orientation corresponding to that of lower end element 32 of FIG. 1. Its flat lower face 208 is engageable by a packer abutment such as that indicated by the reference numeral 39 in FIG. 1. The body 201 is formed with a non-extrusion member 210 in the lower outer corner of the element 200 as shown to prevent extrusion of the polymeric material into the gap G between the packer and the casing as a result of high pressure differentials acting thereon.

The upper end of the end element 200 is formed with a chamfer as at 214*a* to complement the chamfer 105 on the center element 100, as seen in FIG. 3. The improvement in the end element 200 resides in the provision of the upwardly opening cavity 220 which is concentric with the exterior cylindrical surface of the element. This circular cavity 200 has a flat bottom 222 with an inner side wall 224 which is approximately perpendicular to the bottom and curves inwardly as at 226 as it approaches the flat bottom 222, thus providing a suitable fillet. The cavity 220 of this end element is covered by center element 100 when these two elements are assembled next to one another but, since the contact between them is limited to the chamfer 214*a* on this end element, the cavity 220 provides appreciable space into which excess polymeric material may flow during distortion of the elements from their initial relaxed condition to their sealing condition.

Figure 15:
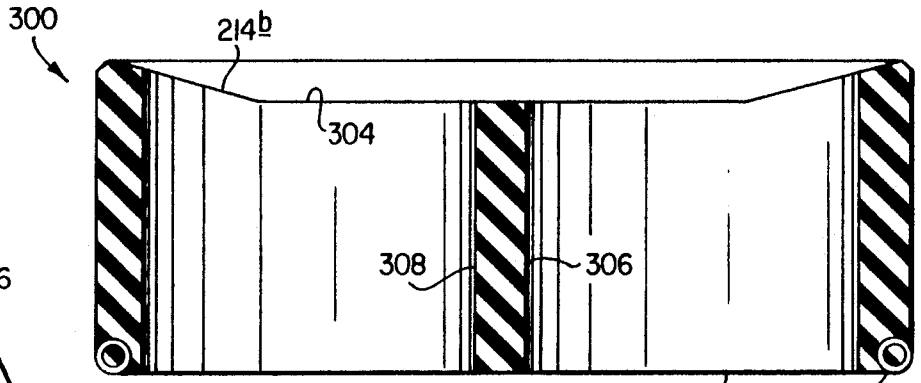
FIG. 15 is a cross-sectional view taken along line 15—15 of FIG. 14.
Figure 16:
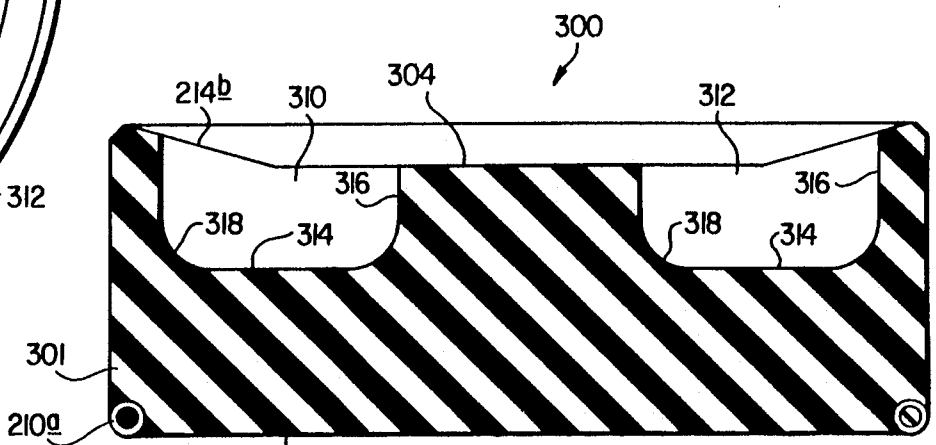
FIG. 16 is a cross-sectional view taken along line 16—16 of FIG. 14.
Figure 14:
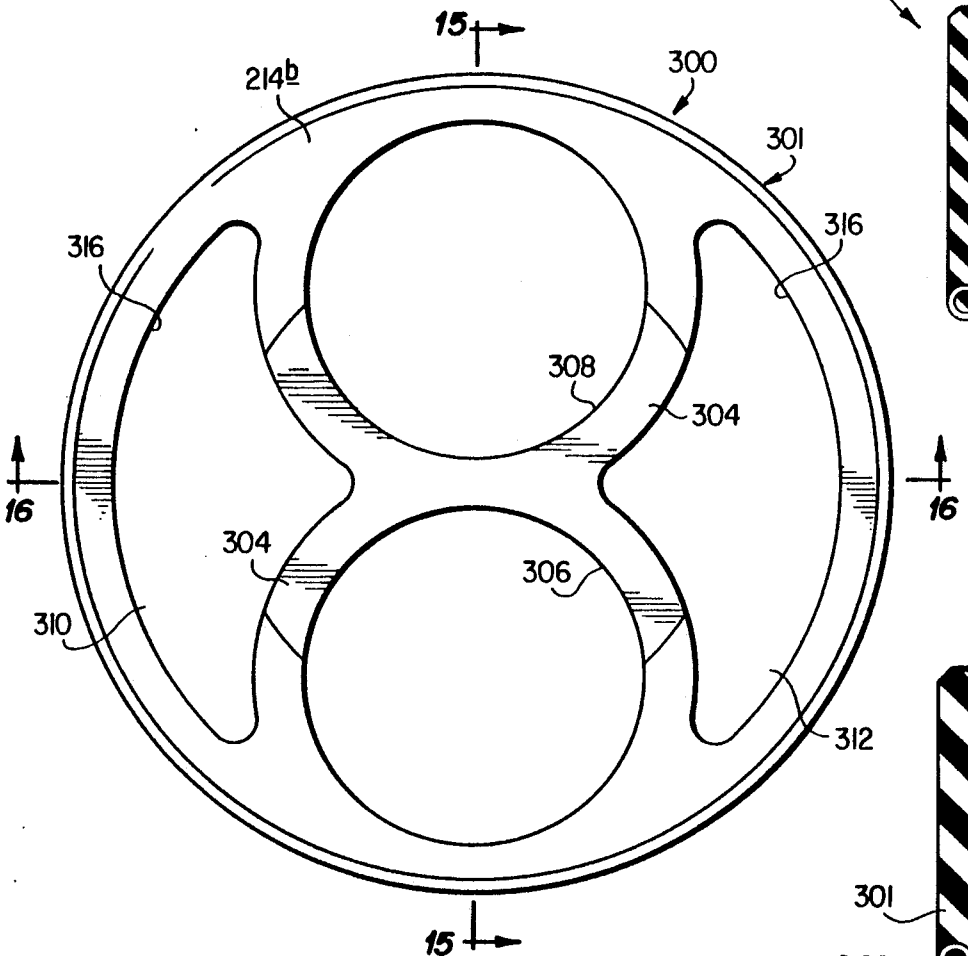
FIG. 14 is a plan View of a second form of end seal element of this invention.

Referring to FIGS. 14–16 it is seen that a second form of end element is illustrated and is indicated generally by the reference numeral 300. End element 300 is formed of suitable polymeric material. This element 300 is shaped much like the first form of end element 200, having a body 301 of circular section and having an exterior cylindrical surface as seen in FIG. 14. The lower end 302 of this element 300, as seen in FIGS. 15 and 16 is formed with a suitable anti-extrusion member 210*a* in its lower outer corner for bridging the gap between the packer and the casing to support the polymeric body of the seal element against extrusion thereof as a result of high pressure differentials acting thereacross. The seal element 300 is formed with a chamfer as at 214*b* at its upper side and with a recessed upper surface as at 304, which corresponds to the mating face of the center element 100 of FIGS. 3–11. The end element 300 is provided with a pair of bores 306 and 308 for receiving a pair of packer mandrels, as before explained with respect to elements 100 and 200.

The improvement in end seal element 300 lies in the provision of a pair of opposed cavities provided at 90 degrees from bores 306 and 308 as at 310 and 312, as shown in FIGS. 14 and 16. The cavities 310 and 312 are each formed with a flat bottom, as at 314, and with walls 316 which are approximately perpendicular thereto. The walls 316 curve inwardly as they approach the bottom 314 as at 318 to provide a suitable fillet. The two cavities 310 provide space for excess polymeric to flow into as the element stack is compressed longitudinally to distort them from their initial relaxed position to their position of sealing between the packer and the casing.

The center seal element 100 is used between a pair of end seal elements such as end element 200 or 300, preferably the former, and are actuated to sealing condition in the well-known manner of compressing them longitudinally by causing the abutments on the packer to be forced toward each other to distort and build up in the seal elements stresses which are sufficient to hold against the pressure differentials expected to be encountered.

It should be clear, however, that while the invention has been described and illustrated as having cavities formed in the seal elements, low density polymeric material for instance could be used to provide the desired voids in the elements. Generally elements with such spongy material incorporated therein would be more difficult and costly to mold.

Figure 17:
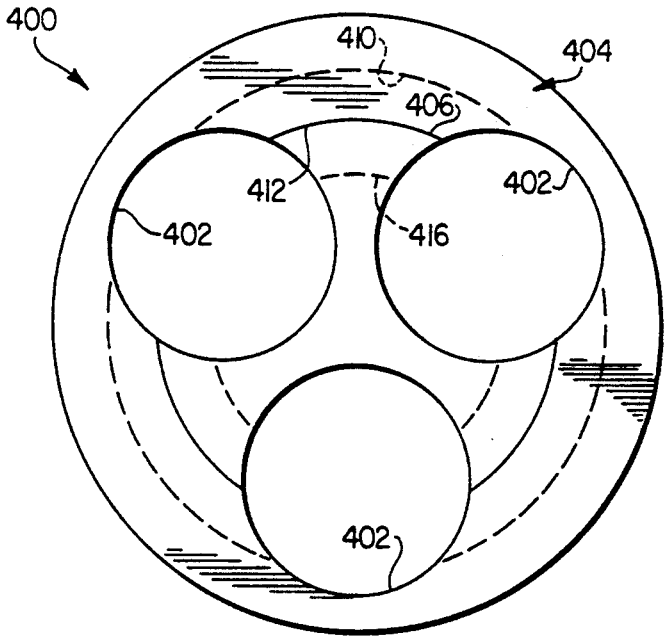
FIG. 17 is schematical plan view similar to that of FIG. 5 but showing a center seal element for use on a triple packer having three mandrels.
Figure 18:
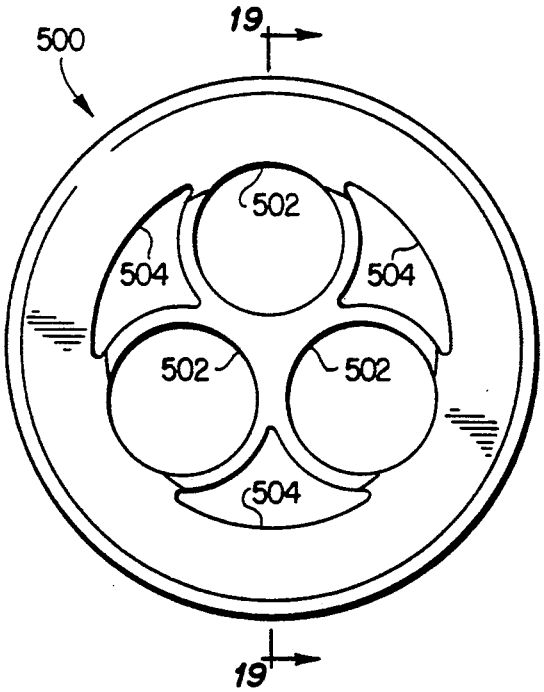
FIG. 18 is a view similar to that of FIG. 14 showing an end element for a triple packer having three mandrels.
Figure 19:
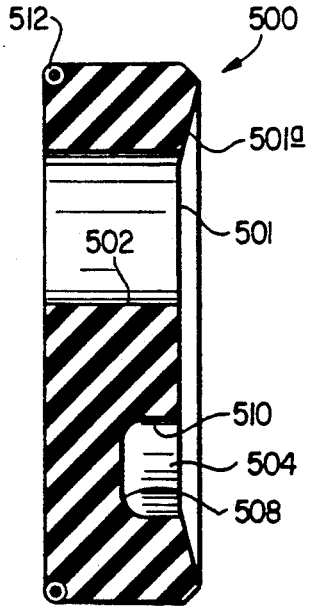
FIG. 19 is a cross-sectional view taken along line 19—19 of FIG. 18.

In FIGS. 17–19, there are illustrated a center seal element and an end seal element for a packer having three mandrels.

In FIG. 17, the center seal element for a triple packer is indicated generally by the reference numeral 400. This illustration is very similar to that of FIG. 5, but shows the element 400 as having three holes, indicated by the reference numeral 402. The seal element 400 is shown made of two members, an outer member 404 and a core member 406. The outer member 404 is formed with a large opening therethrough similar to the opening 130 of seal element 100 and is provided with internal void means which may be in the form of an internal groove as at 410 formed in the inner wall portions 412. The core member 406 is formed similarly to the core member 120 of center seal element 100 and has void means which may be in the form of an internal cavity in the center thereof and having an outward extent as at 416. The seal element 400 is used in the same way as is seal element 100 in FIGS. 3–8 but is adapted to accommodate three packer mandrels. It is particularly useful between two end elements in the manner explained with respect to FIG. 1.

An end seal element for use in a stack of three seal elements for a triple packer having three mandrels is illustrated in FIGS. 18 and 19 where it is indicated generally by the reference numeral 500. This element is formed much like the end seal element 300 of FIGS. 14–16, but could as well be formed with a single large recess centered therein as at 220 in the end seal element 200 of FIGS. 12 and 13, if desired.

End seal element 500, being fashioned similar to end seal element 300, is provided with a recessed face as at 501 and chamfer as at 501*a*, and with three holes 502 as shown and with voids in the form of cavities as at 504 located between adjacent holes 502. The cavities 502 have a flat bottom as at 508, side walls 510 substantially perpendicular to the bottoms, and a suitable fillet provided by the side walls 510 curving inwardly as they approach the bottom 508. End seal element 500 is shown to be provided with anti-extrusion means as at 512, which anti-extrusion means may be exactly like that indicated at 210 is the dual end elements 200 and 300 described previously.

The stack of three seal elements, comprising a center seal element 400 between a pair of end elements such as an end element similar to end element 200 but having three holes rather than two, or a pair of end elements such as end element 500 would be used in the same manner as the elements seen in FIG. 1 with the exception that the packer on which they would be mounted would be provided with three mandrels rather than just two mandrels.

Figure 20:
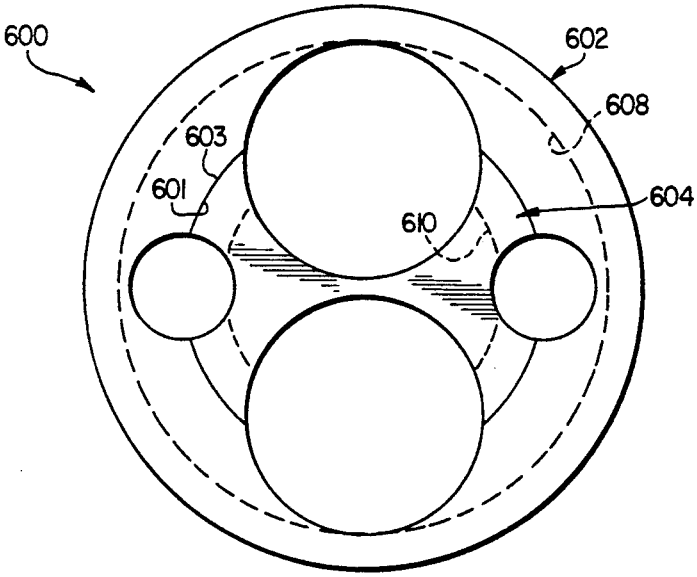
FIG. 20 is a view similar to that of FIG. 17 but showing a center seal element for use on a quadruple packer having four mandrels.
Figure 21:
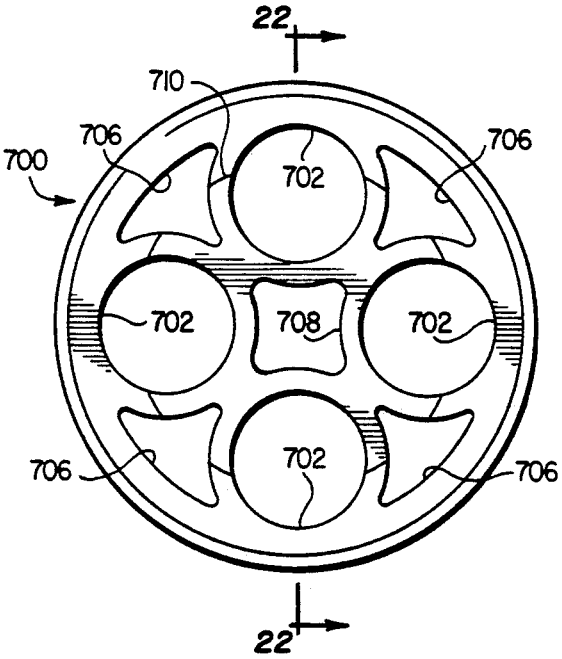
FIG. 21 is an end view similar to that of FIG. 18 but showing an end seal element for use on a quadruple packer.
Figure 22:
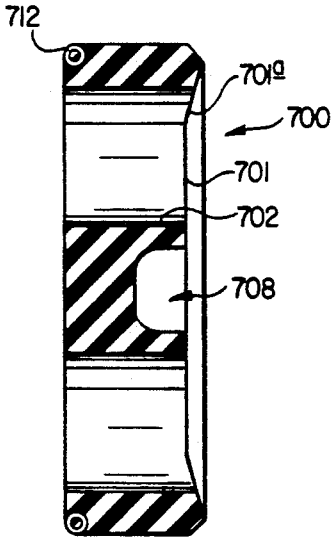
FIG. 22 is a cross-sectional view taken along line 22—22 of FIG. 21.

In FIGS. 20–22, there is illustrated a center seal element and an end seal element for a packer having four mandrels.

In FIG. 20, the center seal element for a quadruple packer is indicated generally by the reference numeral 600. This illustration is much like that of FIG. 5 or FIG. 17, but is shown to be provided with four holes. It should be understood that, although this element is shown with two large holes and two smaller holes, it could as well be provided with four holes of equal size. The smaller holes would accommodate small cylindrical members which, as mentioned before, would include control lines, bypass tubes, injection tubes, as for chemicals for instance, electrical lines, electrical feed through connections, or the like. In a packer for use in a quadruple completion, the four holes would likely all be large, but still may not, however, be equal in size.

The center seal element 600 is structured much like the center elements 100 and 400 illustrated and described hereinabove, being formed in two pieces, including an outer member 602 and a core member 604. The outer member 602 is formed with a large center opening 601 therethrough and with void means which may be in the form of a groove or cavity 608 formed in its inner edge while the core member 604 is formed with void means which may be in the form of cavity 610.

In FIGS. 21 and 22, the end element for a quadruple packer is illustrated and is indicated generally by the reference numeral 700. End element 700 is for use in a stack of elements on a quadruple packer and would be used on each end of such stack.

In FIGS. 21 and 22, end seal element 700 is seen to be provided with a recessed face as at 701 and chamfer 701*a*, and with four holes 702 for receiving four mandrels of a quadruple packer. Void means are provided in this end element and are illustrated as being cavities. There are five cavities. Four cavities 706 are formed in the element at locations between the adjacent holes 702 and are shaped much like the corresponding cavities formed in the end elements 300 and 500 of FIGS. 14 and 18, respectively. Since the four holes 702 are spaced an appreciable distance apart, there is a considerable volume of polymeric material between them. In order to provide better control over the longitudinal compression of this element and the element stack in which it is used, a center cavity is provided as at 708. This central cavity 708, as well as the other four cavities 706 are formed with flat bottoms and walls which are perpendicular thereto with suitable fillets provided at their junctures, as shown. Suitable anti-extrusion means is provided as at 712.

The line indicated by the reference numeral 710 in FIG. 21 shows where the recessed face 701 and the chamfer 701*a* meet.

Figure 23:
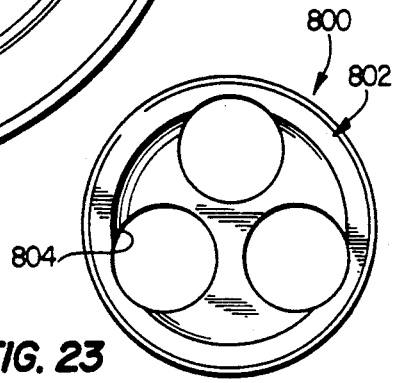
FIG. 23 is a plan view like that of FIG. 12 showing an end element similar to that of FIG. 12 but having three longitudinal bores rather than just two.

Thus, it has been shown that center seal elements and end seal elements can be provided for use on multiple packers having a plurality of mandrels, the center seal elements and end seal elements being formed with void means therein, preferably in the form of cavities, for controlling the distortion of such sealing elements from their initial relaxed condition to their expanded sealing condition such that the stresses built up therein for sealing between the packer and a well pipe will be distributed substantially evenly.

in FIG. 23, an end seal element for a triple packer is illustrated and is indicated generally by the reference numeral 800. This element is formed of a polymeric body 802 which is similar to the end element of FIGS. 12 and 13 in all respects but is provided with three longitudinal bores 804 instead of two, for receiving the three mandrels of a triple packer.

Figure 24:
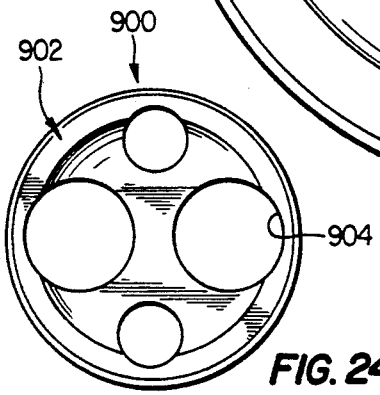
FIG. 24 is a plan view like that of FIG. 12 showing an end element similar to that of FIG. 12 but having four longitudinal bores instead of just two.

Similarly, in FIG. 24, an end seal element for a quadruple packer is illustrated and is indicated generally by the reference numeral 900. This element 900 has a polymeric body 902 which is similar to end element 200 of FIGS. 12 and 13 in all respects but is provided with four longitudinal bores such as at 904 for receiving the four mandrels of a quadruple packer.

Various stacks of seal elements constructed in accordance with this invention are clearly shown in FIGS. 25–36 and will now be described.

Figure 25:
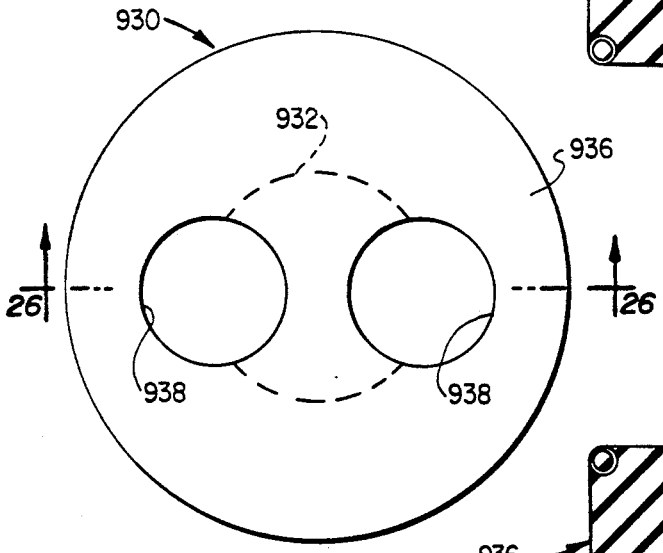
FIG. 25 is an upper end view of a seal element stack for a dual well packer, each of the end elements of which is formed with a single cavity.
Figure 26:
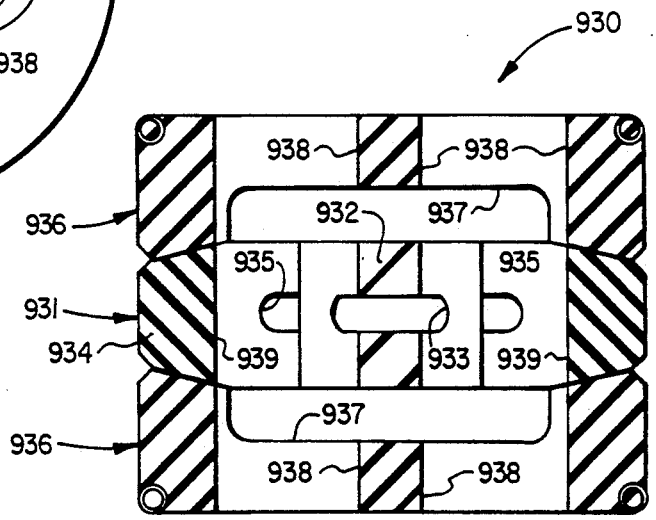
FIG. 26 is a cross-sectional view taken along line 26—26 of FIG. 25.

The element stack in FIGS. 25 and 26 is identified by the reference numeral 930. This seal element stack comprises a center element 931 which may be exactly like that seen in FIGS. 3–11 previously described. This center element is formed in two pieces: an inner portion 932 having a void or cavity 933 and an outer portion 934 having a void or cavity 935, all in accordance with the present invention previously described hereinabove.

The center element 931 of element stack 930 is disposed between upper and lower end elements 936, both of which may be exactly like the end element 200 shown in FIGS. 12 and 13 and previously described. These end elements are each provided with a circular cavity or recess 937 and a pair of bores 938 for receiving the pair of mandrels of a dual well packer. Such mandrels would pass through bores 939 of the center element 931.

Figure 27:
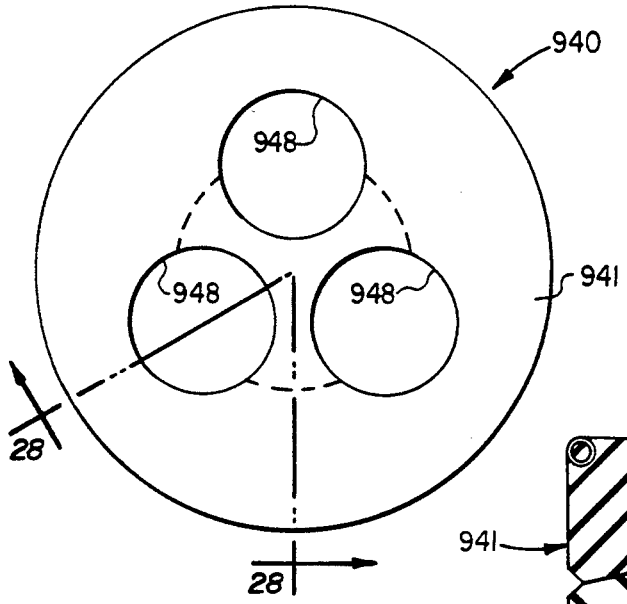
FIG. 27 is an upper end view of a seal element stack similar to that shown in FIGS. 25 and 26 but intended for use on a triple well packer.
Figure 28:
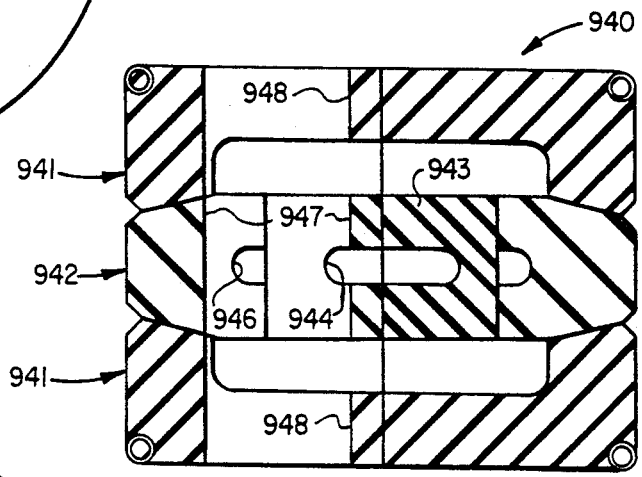
FIG. 28 is a cross-sectional view taken along line 28—28 of FIG. 27.

Similarly, the element stack illustrated in FIGS. 27 and 28 is identified by the reference numeral 940. Element stack 940 includes a pair of end elements 941 which may be exactly like the end element 800 seen in FIG. 23. Elements 941 are each formed with three bores for receiving the three mandrels of a triple well packer. A center element 942 is disposed between the two end elements 941, as shown, and this center element may be structured exactly like or similar to the center element 400 illustrated in FIG. 17 and previously described hereinabove. The center element 942 is like the center element 931 with the exception that it is provided with three bores instead of two. The center portion 943 thereof is formed with a cavity 944 and the outer element 943 is formed with a circular cavity 946. The center element has three bores 947 which align with the three bores 948 of the end elements 941.

Figure 29:
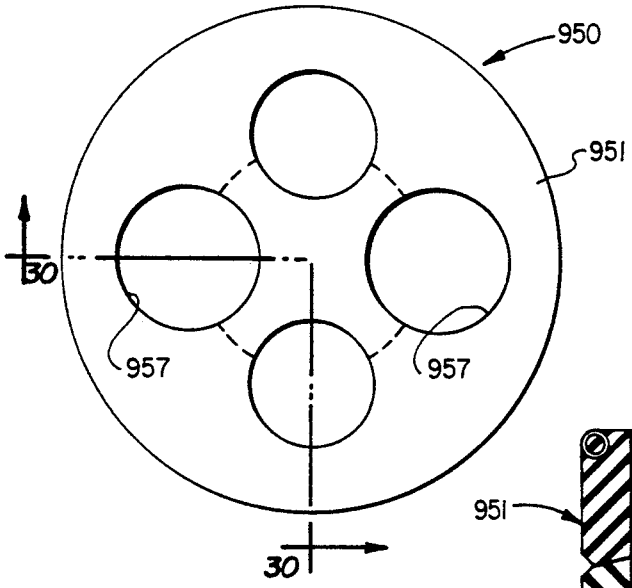
FIG. 29 is an upper end view of a seal element stack similar to that shown in FIGS. 27 and 28 but intended for use on a quadruple well packer.
Figure 30:
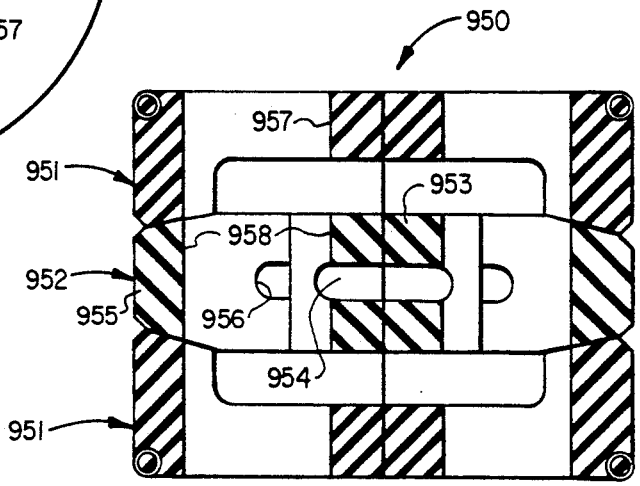
FIG. 30 is a cross-sectional view taken along line 30—30 of FIG. 29.

The seal element stack illustrated in FIGS. 29 and 30 is identified by the reference numeral 950. This element stack includes a pair of end elements 951 with a center seal element 952 disposed therebetween. The center element 952 is formed in two pieces. The inner piece 953 is provided with a cavity 954 and the outer piece 955 is provided with a circular cavity 956. End element 951 is formed with 4 bores 957. Center element 952 is provided with corresponding bores 958. These 957 of the end element 951 align with the bores 958 of the center element 952 and accommodate the four mandrels of a quadruple well packer.

In FIGS. 31–36 three seal element stacks are illustrated. These three stacks are for use on packers having two, three, or four mandrels.

Figure 31:
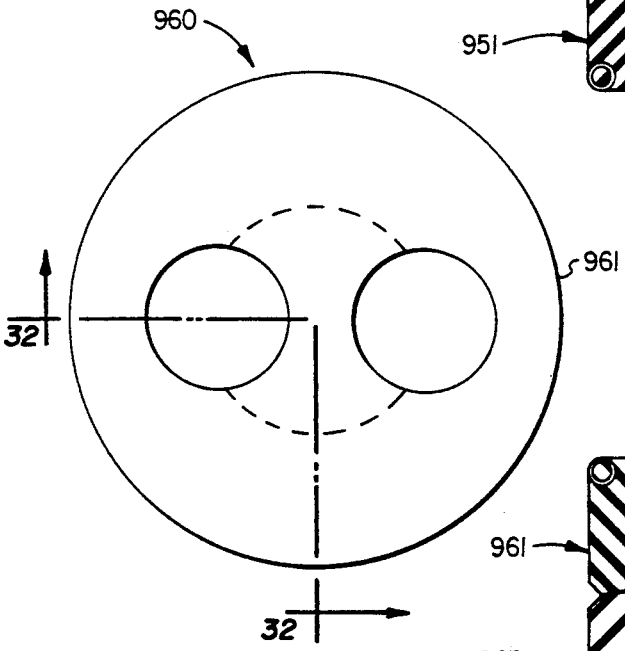
FIG. 31 is an upper end view of a seal element stack for a dual well packer, each of the end elements of which is formed with plural cavities.
Figure 32:
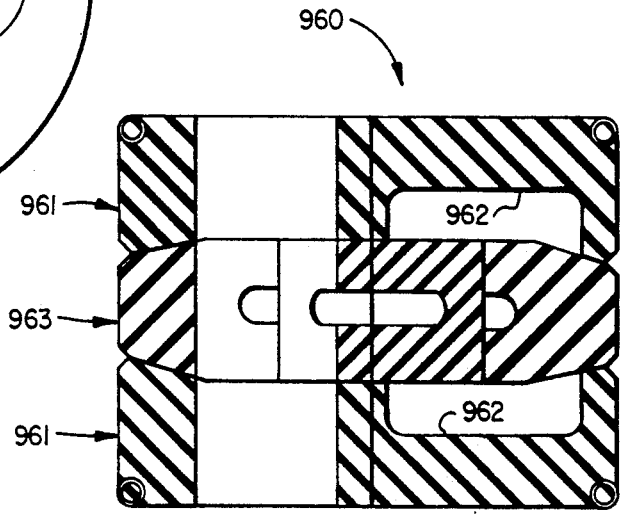
FIG. 32 is a cross-sectional view taken along line 32—32 of FIG. 31.

In FIGS. 31 and 32, a seal element stack for dual well packers is illustrated and is identified by the reference numeral 960. The stack includes a pair of end elements 961 which may be exactly like the end element of FIGS. 14–16. This end element is provided with a pair of void means in the form of cavity 962, only one of which is shown since the cutting plane passes through but one. (See FIGS. 14–16.) Center element 963 may be exactly like center element 931 of FIG. 26.

Figure 33:
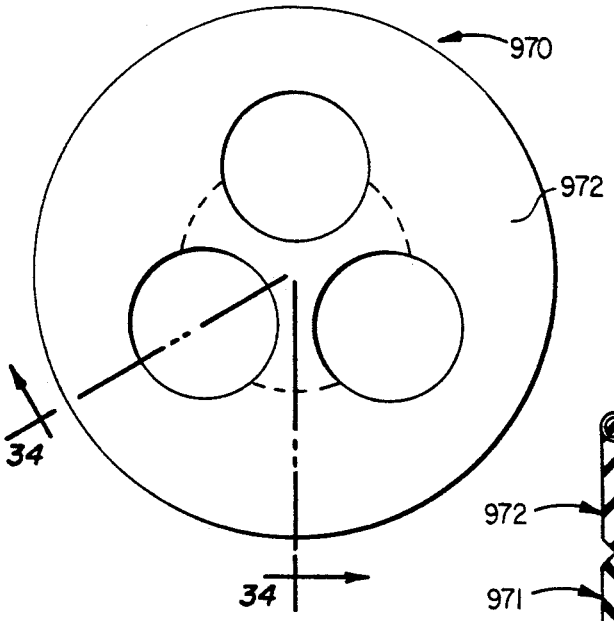
FIG. 33 is an upper end view of a seal element stack similar to that shown in FIG. 27 and 28 but intended for use on a triple well packer.
Figure 34:
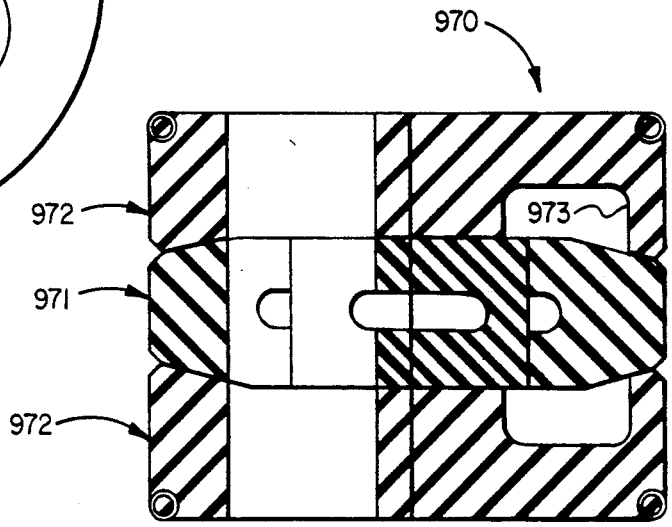
FIG. 34 is a cross-sectional view taken along line 34—34 of FIG. 33.

Similarly, FIGS. 33 and 34 illustrate a seal element stack 970 which is intended for use on a triple well packer. This element stack 970 includes a center element 971 which may be exactly like the center element 942 of FIG. 28. The center element 971 is disposed between a pair of end elements 972 which may be exactly like the end element 500 of FIGS. 18 and 19. This end element is provided with void means in the form of three cavities like cavity 973 although only one is shown due to the cutting plane passing through only one.

Figure 35:
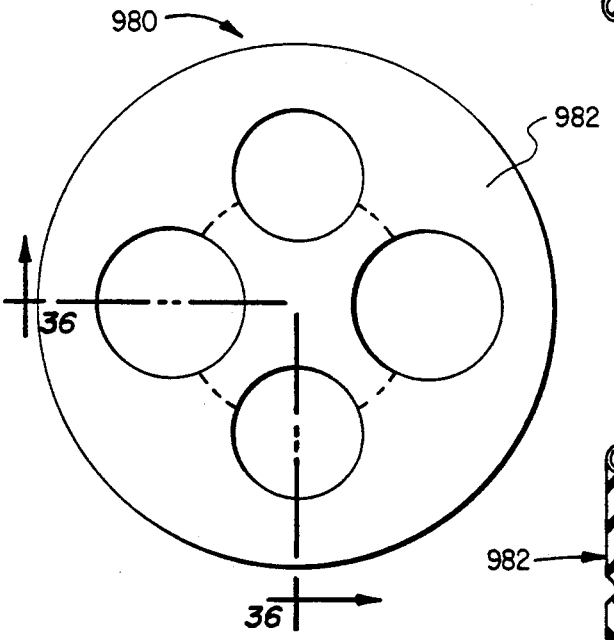
FIG. 35 is an upper end view of a seal element stack similar to that shown in FIGS. 32 and 33 but intended for use on a quadruple well packer.
Figure 36:
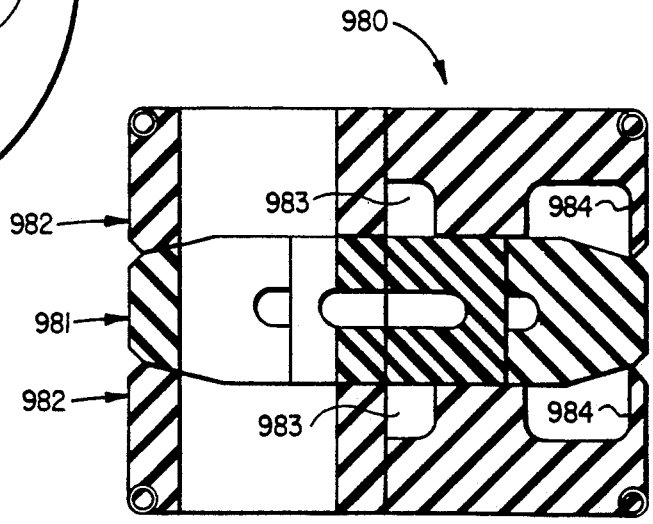
FIG. 36 is a cross-sectional view taken along line 36—36 of FIG. 35.

In FIGS. 35 and 36 there is illustrate a seal element stack for a quadruple packer and it is identified by the reference numeral 980. This element stack includes a center element 981 disposed between a pair of opposed end elements 982. End elements 982 may be like the end element illustrated in FIGS. 21 and 22. This end element is formed with void means in the form of five cavities or recesses. One of these recesses 983 is formed at the center of the element and in its face which engages or interfaces with the center element. The four other cavities 984 are located toward the outer edge of the element but spaced inwardly therefrom and between adjacent mandrels, as seen in FIG. 18.

The foregoing description and drawings of this invention are explanatory and illustrative only and variations in the sizes and shapes of the cavities in the seal elements may be made within the scope of the appended claims without departing from the true spirit of the invention.

I claim:

1. Seal means for use on a multiple packer for sealing between a plurality of mandrels and the inner wall of a well pipe, said seal means comprising: body means of polymeric material having a plurality of longitudinal holes therethrough for receiving said plurality of mandrels and capable of being distorted into sealing engagement with the inner wall of said well pipe by being expanded laterally in response to being compressed longitudinally, said seal means being formed with void means therein for controlling longitudinal and lateral displacement and associated strain of said polymeric material to facilitate such distortion.

2. Seal means for use on a multiple packer for sealing between a plurality of packer mandrels and the inner wall of a well pipe, said seal means comprising: a body of polymeric material having a plurality of longitudinal bores therethrough for receiving said plurality of packer mandrels and capable of being distorted into sealing engagement with said well pipe by being expanded laterally in response to being compressed longitudinally, said seal element having void means therein for controlling such distortion of the polymeric material of said body such that the stresses created in said polymeric material will be more uniformly distributed therein.

3. The seal means of claim 2, wherein said seal means includes a stack of a plurality of seal elements at least one of which is provided with void means.

4. The seal means of claim 3, wherein said seal means includes a stack of three seal elements, the center element of which is provided with void means.

5. The seal element stack of claim 3, wherein said seal means includes a stack of three elements the center seal element of which is formed in two members, namely, a core member and an outer member surrounding said core member, and each of said inner and outer members is provided with void means.

6. The seal means of claim 3, wherein said seal means includes a stack of three seal elements, each of which is provided with void means.

7. The seal means of claim 1, 2, 3, 4, 5, or 6, wherein said plurality of holes is two holes for receiving the two mandrels of a dual packer.

8. The seal means of claim 7, wherein said void means is one or more cavities.

9. The seal means of claim 1, 2, 3, 4, 5, or 6, wherein said plurality of holes is three holes for receiving the three mandrels of a triple packer.

10. The seal means of claim 9, wherein said void means is one or more cavities.

11. The seal means of claim 1, 2, 3, 4, 5, or 6, wherein said plurality of holes is four holes for receiving the four holes of a quadruple packer.

12. The seal means of claim 11, wherein said void means is one or more cavities.

13. A center seal element for use on a multiple packer having a plurality of mandrels comprising: body means of polymeric material, said body means being formed with a plurality of holes therethrough for receiving said plurality of mandrels, and being formed in two separate members including an outer member and a core member, said outer member being formed with a peripheral cylindrical surface and with an opening extending longitudinally therethrough, said opening providing inner wall means comprising multiple pairs of opposed arcuate wall portions, including a first pair of opposed arcuate wall portions being engageable with said pair of mandrels and a second pair of opposed arcuate wall sections being engageable with corresponding outer walls of said core member, said outer member being formed with an internal arcuate groove in each of said second pair of opposed wall portions and opening into said longitudinal opening, each said groove being substantially closed by said core member to form a long arcuate cavity, said core member being formed with a pair of opposed outer arcuate walls for engaging said second pair of opposed arcuate walls of said outer member and with two pairs of arcuate edge surfaces spaced apart longitudinally, each pair of said arcuate edge surfaces being engageable with one of said pair of mandrels, said core member having cavity means therein on substantially the same level with said arcuate groove of said outer member and having diameter substantially equaling that of said core member said cavity means of said core member opening between said edge surfaces.

14. The center seal element of claim 13, wherein the outside diameter of said core member equals about 45 to 60 percent of the outside diameter of said outer member.

15. The center seal element of claim 13 or 14, wherein said plurality of holes is two holes for receiving the two mandrels of a dual packer.

16. The center seal element of claim 13 or 14, wherein said plurality of holes is three holes for receiving the three mandrels of a triple packer.

17. The center seal element of claim 13 or 14, wherein said plurality of holes is four holes for receiving the four mandrels of a quadruple packer.

18. An end seal element for use on a multiple packer having a plurality of mandrels, comprising: body means of polymeric material, said body means being formed with a plurality of holes therethrough for receiving said plurality of mandrels, said body means being further provided with void means in the form of a substantially circular cavity formed in its inward face and substantially concentric therewith.

19. The end seal element of claim 18, wherein said plurality of holes is two holes for receiving the two mandrels of a dual packer.

20. The end seal element of claim 18, wherein said plurality of holes is three holes for receiving the three mandrels of a triple packer.

21. The end seal element of claim 18, wherein said plurality of holes is four holes for receiving the four mandrels of a quadruple packer.

22. An end seal element for use on a multiple packer having a plurality of mandrels, comprising: body means of polymeric material, said body means being formed with a plurality of holes therethrough for receiving said plurality of mandrels, said body means being further provided with void means in the form of a plurality of cavities formed in its inward face and eccentric thereto.

23. The end seal element of claim 22, wherein said plurality of holes is two holes for receiving the two mandrels of a dual packer.

24. The center seal element of claim 22, wherein said plurality of holes is three holes for receiving the three mandrels of a triple packer.

25. The center seal element of claim 22, wherein said plurality of holes is four holes for receiving the four mandrels of a quadruple packer.

26. An element stack for a well packer for sealing between a plurality of packer mandrels and the inner wall of a well pipe, said element stack comprising at least one center element positioned between a pair of end elements, each said center element comprising:

(a) body means of polymeric material, said body having an exterior cylindrical surface and being formed with a plurality of longitudinal holes therethrough for receiving said plurality of mandrels of said well packer, said body means being further formed in two members, namely, a core member and an outer member surrounding said core member; and (b) each of said inner and outer members being provided with void means;

and each said end element comprising:

(c) body means of polymeric material, said body means being formed with a plurality of longitudinal holes therethrough for receiving said plurality of mandrels of said well packer, said body means being further formed with a substantially circular cavity on its inward face which engages said center element and substantially concentric with said exterior cylindrical surface.

27. The element stack of claim 26, wherein said center and end elements are each formed with two longitudinal holes therethrough for receiving the two mandrels of a dual well packer.

28. The element stack of claim 26, wherein said center and end elements are each formed with three longitudinal bores therethrough for receiving the three mandrels of a triple well packer.

29. The element stack of claim 26, wherein said center and end elements are each formed with four longitudinal bores therethrough for receiving the four mandrels of quadruple well packer 30.

30. An element stack for a well packer for sealing between a plurality of packer mandrels and the inner wall of a well pipe, said element stack comprising at least one center element positioned between a pair of end elements, each said center element comprising:

(a) body means of polymeric material, said body having an exterior cylindrical surface and being formed with a plurality of longitudinal holes therethrough for receiving said plurality of mandrels of said well packer, said body means being further formed in two members, namely, a core member and an outer member surrounding said core member; and (b) each of said inner and outer members being provided with void means;

and each said end element comprising:

(c) body means of polymeric material, said body means being formed with a plurality of longitudinal holes therethrough for receiving said plurality of mandrels of said well packer, said body means being further formed with void means in the form cavities formed in the inward face which engages said center element and eccentric to said exterior cylindrical surface.

31. The element stack of claim 30, wherein said center and end elements are each formed with two longitudinal holes therethrough for receiving the two mandrels of a dual well packer.

32. The element stack of claim 30, wherein said center and end elements are each formed with three longitudinal bores therethrough for receiving the three mandrels of a triple well packer.

33. The element stack of claim 30, wherein said center and end elements are each formed with four longitudinal bores therethrough for receiving the four mandrels of quadruple a well packer.

* * * * *